United States Patent [19]

Brian

[11] Patent Number: 4,574,996

[45] Date of Patent: Mar. 11, 1986

[54] MULTI-CELL CONTAINER

[75] Inventor: James A. Brian, San Antonio, Tex.

[73] Assignee: Crown Zellerbach Corporation, San Francisco, Calif.

[21] Appl. No.: 744,183

[22] Filed: Jun. 13, 1985

[51] Int. Cl.[4] ..... B65D 5/48; B65D 5/46

[52] U.S. Cl. ..... 229/27; 229/28 R; 229/52 B; 229/52 BC

[58] Field of Search ..... 229/15, 27, 28 R, 28 BC, 229/29 D, 42, 52 B, 52 BC

[56] References Cited

U.S. PATENT DOCUMENTS

| | | | |
|---|---|---|---|
| 557,371 | 3/1896 | Ferguson | 229/27 |
| 1,928,660 | 10/1933 | Boeye | 229/27 |
| 1,975,240 | 10/1934 | Verhoven | 229/15 |
| 2,023,578 | 12/1935 | Daley | 229/27 |
| 2,599,800 | 6/1952 | Wolfe | 229/28 R |
| 2,693,308 | 11/1954 | Giroux et al. | 229/28 R |
| 2,711,819 | 6/1955 | Vander Lugt, Jr. | 229/27 |
| 2,823,845 | 2/1958 | Wasyluka | 229/15 |
| 3,208,659 | 9/1965 | Blasdell et al. | 229/27 |
| 4,091,926 | 5/1978 | Cravens | 229/29 D |
| 4,108,348 | 8/1978 | Partain | 229/27 |
| 4,347,967 | 9/1982 | Loudermilk, Jr. | 229/27 |
| 4,408,710 | 10/1983 | Aust | 229/15 |

FOREIGN PATENT DOCUMENTS

| | | | |
|---|---|---|---|
| 2353218 | 10/1975 | Fed. Rep. of Germany | 229/15 |
| 359083 | 10/1931 | United Kingdom | 229/27 |
| 732889 | 6/1955 | United Kingdom | 229/27 |
| 1185475 | 3/1970 | United Kingdom | 229/27 |

*Primary Examiner*—William Price
*Assistant Examiner*—Gary E. Elkins
*Attorney, Agent, or Firm*—Thomas R. Lampe

[57] ABSTRACT

A multi-cell container having two pairs of bottom flaps and divider panels connected to the flaps and extending into the container interior to form the cells. The divider panels connected to one pair of opposed walls are positioned in slits formed in the divider panels connected to the other pair of opposed walls. Hand hold flaps engage divider panels and exert an upward force on them when the container is carried to provide bottom strength.

18 Claims, 8 Drawing Figures

MULTI-CELL CONTAINER

BACKGROUND AND SUMMARY OF THE INVENTION

This invention relates to a container, and more particularly to a multi-cell box for transporting bottles and similar objects.

The container is characterized by its simplicity and inexpensive construction, being preferably formed from a single piece corrugated paperboard blank. The box is readily and quickly fully assembled from the blank into a strong and stable container highly suitable for the transport of relatively heavy objects such as full bottles of soft drinks which may, for example, be in the order of two or three liter capacity or more.

Besides having an overall construction which facilitates rapid set-up and knock-down, the container incorporates a unique locking arrangement which serves to maintain the divider panels forming the container cells in a stable interconnected relationship. This feature is particularly important in automated box filling operations wherein an improperly positioned divider panel or partition can cause machine jam-up.

The present container also incorporates a special hand hold flap and divider panel construction cooperable to provide support for the container bottom whereby the effective strength of the bottom is increased.

DETAILED DESCRIPTION

Figure 1:
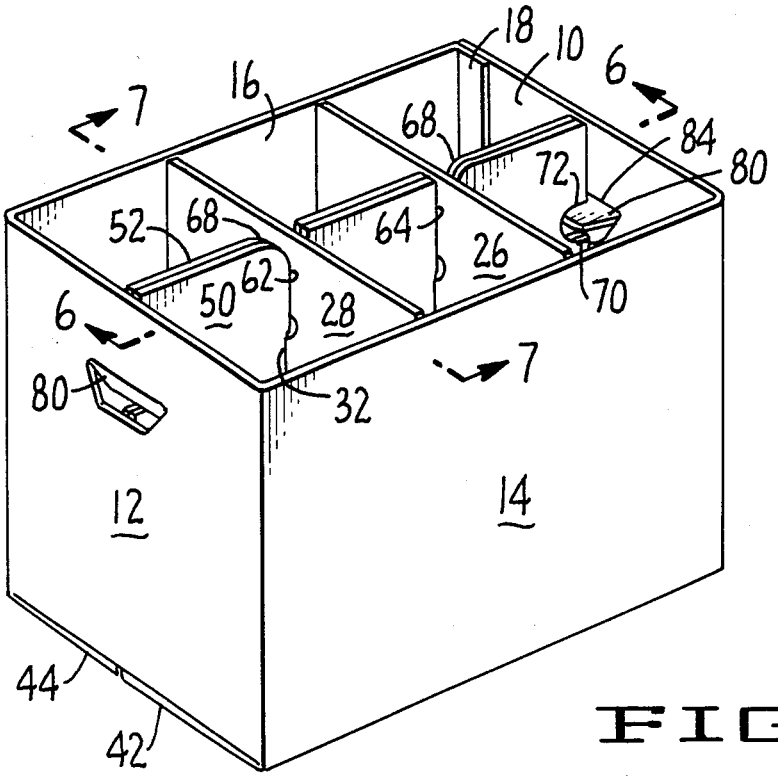
FIG. 1 is a perspective view of a preferred form of container constructed in accordance with the teachings of the present invention, and shown fully assembled.
Figure 3:
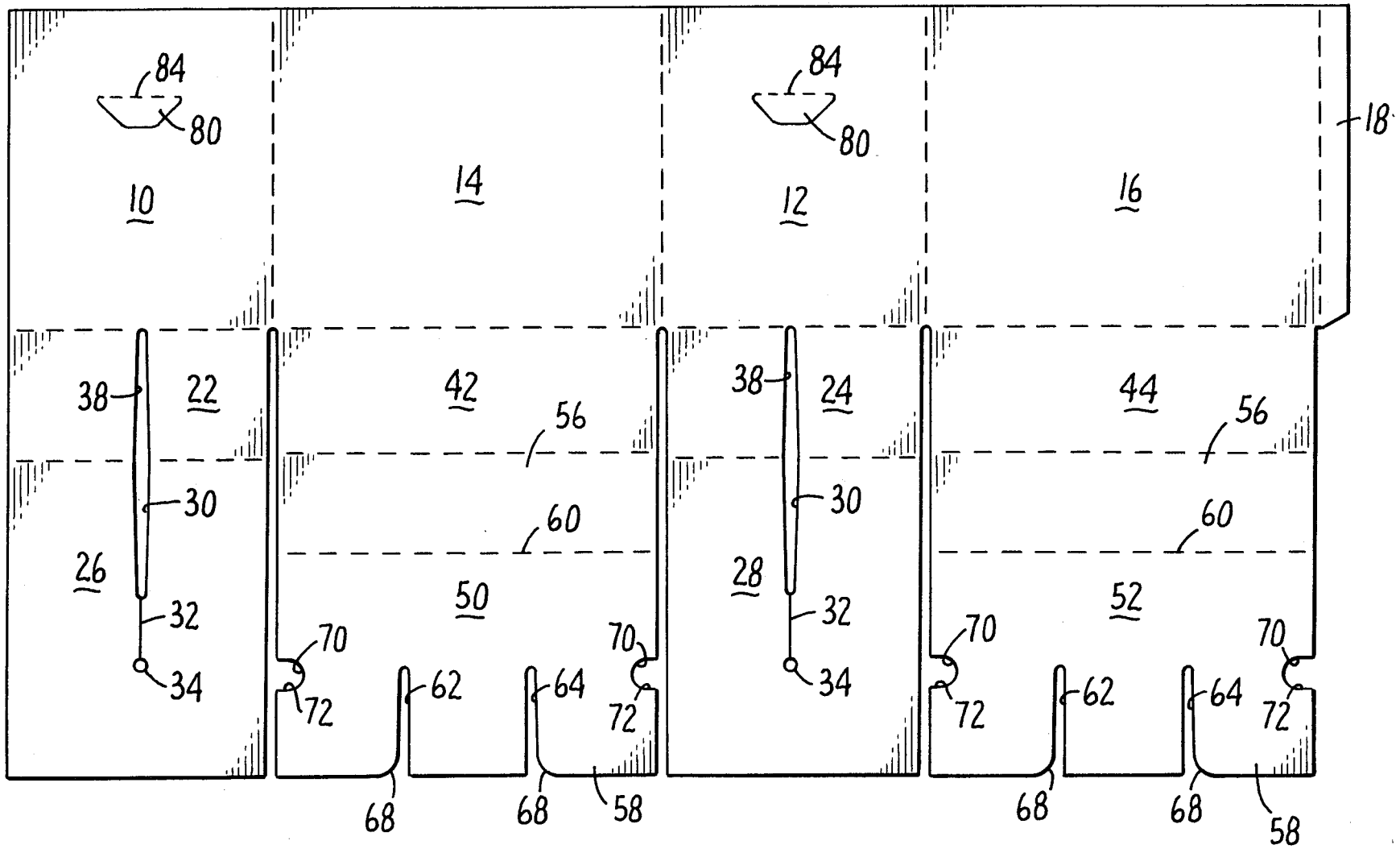
FIG. 3 is a plan view of a one-piece blank used to construct the container of FIG. 1.

The container or box shown in FIG. 1 is constructed from a single piece blank of corrugated paperboard or the like shown in FIG. 3.

The blank includes a pair of first wall panels 10, 12 and a pair of second wall panels 14, 16 connected to the first wall panels and adapted to form a container interior when the container is assembled. In the disclosed embodiment, assembly of the wall panels is accomplished through the use of a glue joint 18 which is secured to first wall panel 10 by adhesive in a conventional manner. As may be seen with reference to FIG. 1, when the container is fully assembled, the first wall panels 10, 12 are in an opposed relationship, as are second wall panels 14, 16.

First bottom flaps 22, 24 are connected along fold lines to first wall panels 10, 12, respectively. The first bottom flaps, when the container is assembled, are adapted to extend from the first wall panels under the container interior.

First divider panels 26, 28 are connected to the first bottom flaps 22, 24, respectively. The first divider panels each have an aperture 30 formed therein. In each first divider panel an elongated slit 32 communicates with aperture 30 and extends therefrom as shown. At the other end thereof, the elongated slit 32 communicates with a hole 34 formed in each first divider panel. Each hole 34 is circular in configuration, spaced from the first divider panel aperture, and is positioned along a line extending through a longitudinal axis of the first divider panel aperture and the slit.

First divider panel apertures 30 are tapered over a substantial portion of the length thereof and narrow in the direction of the slit with which the aperture communicates. As may be seen, each first divider panel aperture has a curved end at the location of communication between the aperture and slit. At its other end, each aperture 30 is in communication with an aperture 38 of generally like configuration formed in the first bottom flap. Apertures 38 extend virtually the full width of their respective first bottom flaps.

Second bottom flaps 42, 44 are connected along fold lines to second wall panels 14, 16, respectively, and are adapted to extend therefrom under the container interior upon formation thereof.

Second divider panels 50, 52 are foldably connected to second bottom flaps 42, 44, respectively. Second divider panels 50, 52 each includes two adjacent sub-panels 56, 58 foldable relative to one another along a fold line 60. In addition, each second divider panel has indentations 62, 64 therein, the indentions being partially defined by curved surfaces 68 formed on the second divider panels.

Notches 70 are formed at the edges of the second divider panels. The second divider panels have bearing surfaces 72 at the location of the notches. As will be described in greater detail below, the bearing surfaces 72 are engagable by hand hold flaps 80 formed in the first wall panels 10, 12.

Figure 2:
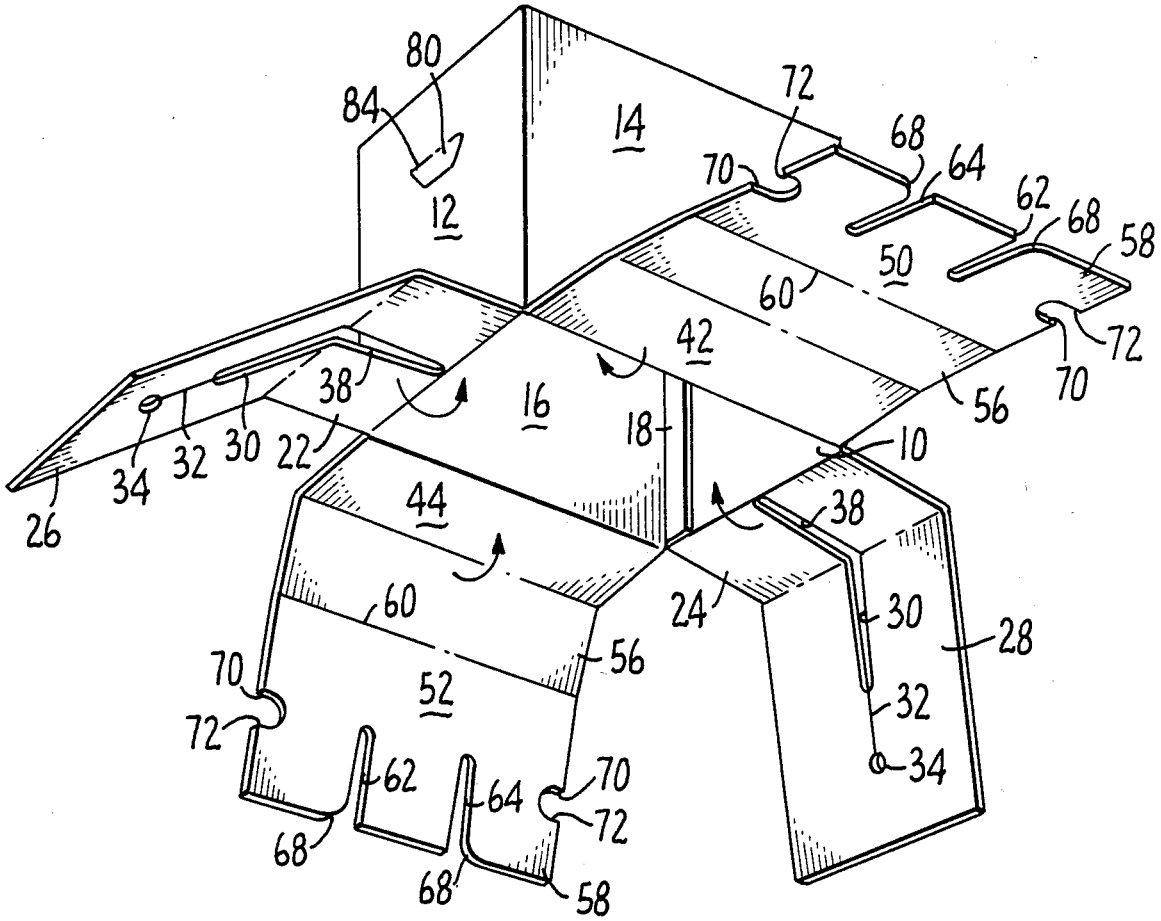
FIG. 2 is a perspective view of the container of FIG. 1 in partially assembled condition.
Figure 4:
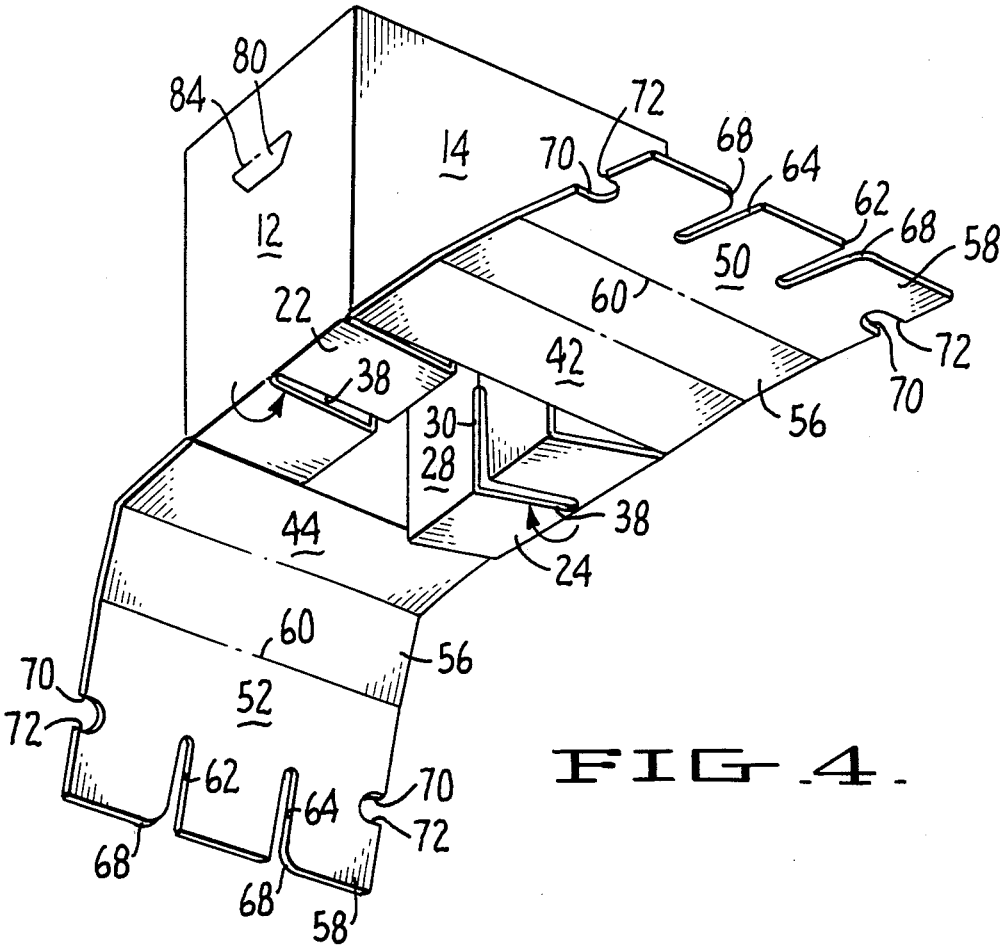
FIGS. 4 and 5 are views similar to that of FIG. 1, but showing the container in later consecutive stages of partial assembly.

Assembly of the container will not be described. After glue joint 18 has been secured to first wall panel 10 in the manner shown in FIG. 2, the wall panels are manipulated to form a pair of first opposed walls 10, 12 and a pair of second opposed walls 14, 16 defining a container interior therewith. First bottom flaps 22, 24 and first divider panels 26, 28 are manipulated as shown in FIG. 4 so that the first bottom flaps extend under the container interior and the first divider panels extend into the container interior in spaced, generally parallel condition.

Figure 5:
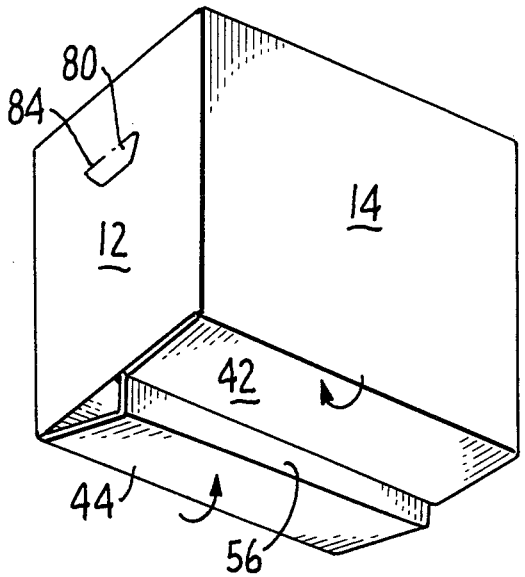

Next, the second bottom flaps 42, 44 and the second divider panels 50, 52 are manipulated and the second divider panels are pushed into the communicating apertures 30, 38 of the first bottom flaps and the first divider panels. This action is facilitated by the fact that the sub-panels 56, 58 can be bent about fold line 60. FIG. 5 shows the container almost fully assembled.

The container, when fully assembled, is shown in FIGS. 1 and 6–8. As may readily be seen, in the assembled container the second divider panels are positioned in the first divider panel apertures and slits. The second divider panels are in abutting registry when so positioned so that in the illustrated embodiment six cells are formed by the first and second divider panels.

Figure 8:
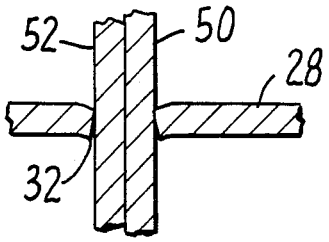
FIG. 8 is an enlarged cross-sectional view taken along line 8—8 in FIG. 7.

The elongated slits 32 formed in the first divider panels 26, 28 are considerably narrower when the slits are unstressed than the combined width of the abutting second divider panels 50, 52. Thus, when the second divider panels are forced into the slits upon assembly of the container, the first divider panels 26, 28 are distorted at the slit locations as shown in FIG. 8, and bear against the second divider panels to impede movement thereof and lock the first and second divider panels in relative position within the container interior.

Above the slits, the first divider panels are accomodated within the indentations 62, 64 formed in the second divider panels 50, 52. As previously stated, the second divider panels have curved surfaces 68 formed therein. This feature, along with the above-described sub-panel construction of the second divider panels, facilitates positioning of the second divider panels with respect to the first divider panels when the container is formed. The first divider panels are, of course, under stress when the second divider panels are forced into the slits. The holes 34 formed in the first divider panels function to distribute such stresses so that the first divider panels do not rip or tear during assembly.

Figure 6:
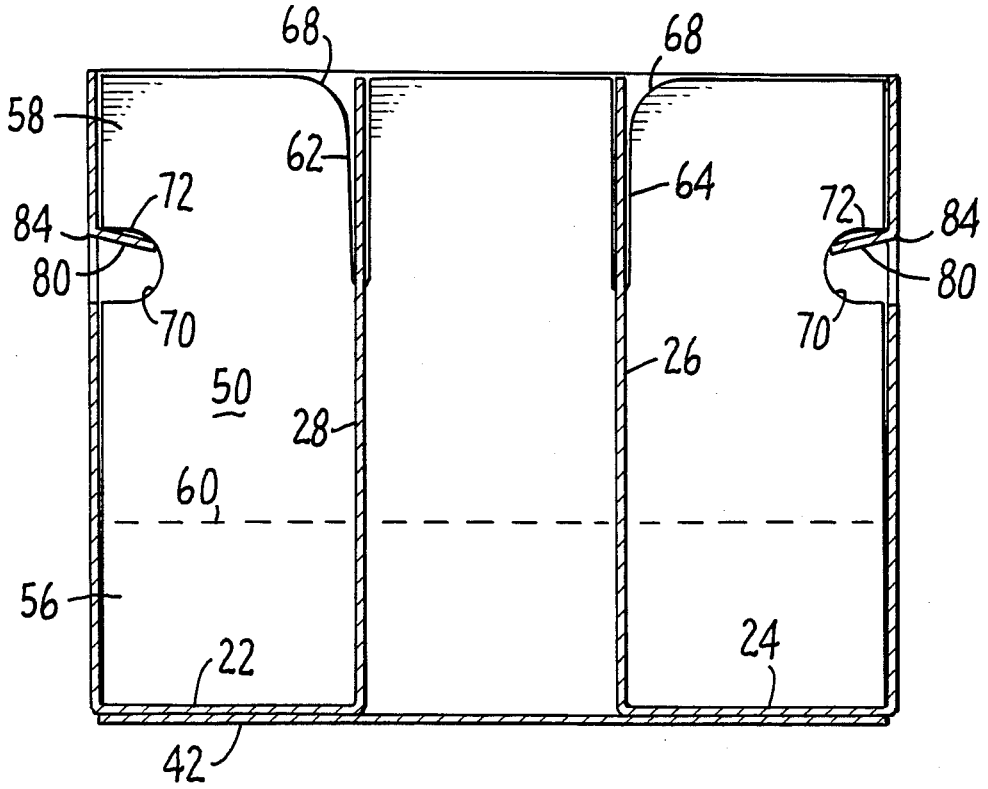
FIG. 6 is a cross-sectional view taken along line 6—6 in FIG. 1.
Figure 7:
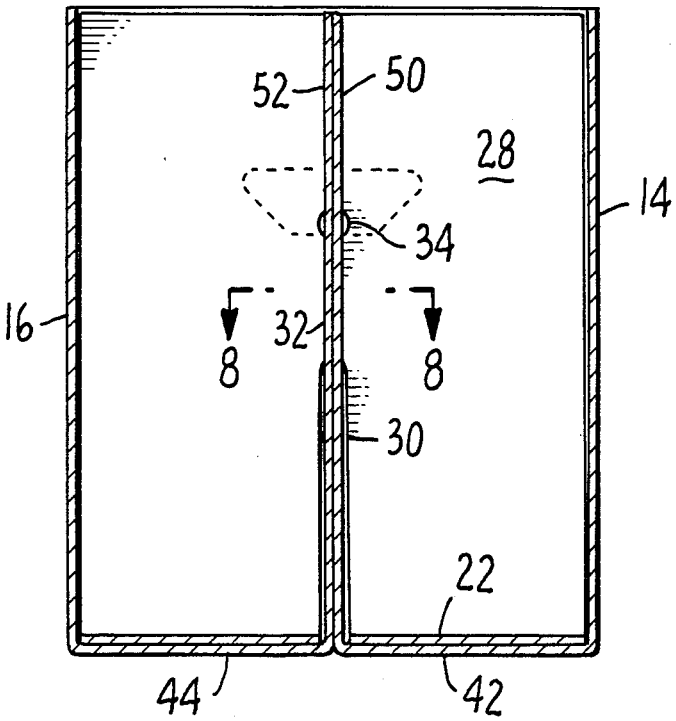
FIG. 7 is a cross-sectional view taken along line 7—7 in FIG. 1.

As may perhaps best be seen with reference to FIGS. 1 and 6, when the container is fully assembled, the notches 70 formed in the second divider panels 50, 52 are in registry with hand hold flaps 80 formed in the first wall panels 10, 12. The hand hold flaps 80 are pushed inwardly about fold lines 84 so that the flaps bear against bearing surfaces 72 defined by the notches. When the container is carried by the hand hold flaps, an upwardly directed pressure is exerted against second divider panels 50, 52 at the bearing surfaces; thus, second bottom flaps 42, 44 are also supported. This feature adds significant strength to the container bottom.

The container of this invention may be constructed of any suitable material, but the preferred material from the standpoint of economy and strength is corrugated paperboard. While a glue joint 18 is shown as the means by which the walls of the container are secured together, any suitable expedient such as staples may be employed if desired.

I claim:

1. A container comprising:

a pair of first opposed walls, each said first opposed wall having a hand hold flap therein;

a pair of second opposed walls connected to said pair of first opposed walls and defining a container interior therewith;

a first bottom flap connected to each first opposed wall and extending therefrom under said container interior;

a first divider panel connected to each first bottom flap and extending into said container interior, said first divider panels each having an aperture formed therein and an elongated slit communicating with said aperture and extending from said aperture;

a second bottom flap connected to each second opposed wall and extending therefrom under said container interior; and a second divider panel connected to each second bottom flap and extending into said container interior, said second divider panels having notches formed at edges thereof and bearing surfaces at the location of said notches, said second divider panels being positioned in said first divider panel apertures and slits with said second divider panels abutting and in at least partial registry, said hand hold flaps being in registry with said notches when said second divider panels are positioned in said first divider panel apertures and slits, and said hand hold flaps positionable within said notches to bear against said second divider panel bearing surfaces, thereby facilitating lifting and carrying of said containers and providing at least partial support for the contents of said container.

2. The container of claim 1 wherein each said first bottom flap defines an aperture therein in communication with the aperture formed in the first divider panel connected thereto, said second divider panels being positioned in the first bottom flap apertures.

3. The container of claim 1 wherein said elongated slits each communicate at one end thereof with a first divider panel aperture and at the other end thereof with a hole formed in the first divider panel.

4. The container of claim 3 wherein each first divider panel aperture is tapered over a substantial portion of the length thereof and narrows in the direction of the slit with which the aperture communicates, said first divider panel aperture having a curved end at the location of communication between said aperture and said slit.

5. The container of claim 1 wherein the combined thickness of said abutting second divider panels is greater than that of said slit when said slit is unstressed, whereby the first divider panels are distorted at the slit locations and bear against the second divider panels to impede movement thereof and lock said first and second divider panels in position within said container interior.

6. The container of claim 3 wherein the hole formed in each first divider panel is spaced from said first divider panel aperture, is circular in configuration, and is positioned along a line extending through a longitudinal axis of said first divider panel aperture and said slit.

7. The container of claim 1 wherein each said second divider panel includes at least two adjacent sub-panels foldable relative to one another along a fold line.

8. The container of claim 1 wherein each said second divider panel has indentations formed therein receiving said first divider panels therein when said second divider panels are positioned in said first divider panel apertures and slits.

9. The container of claim 8 wherein said indentations are partially defined by curved surfaces formed on said second divider panels.

10. A unitary blank of paperboard material used to construct a container, said blank comprising:

a pair of first wall panels, each said first opposed wall panel having a hand hold flap therein;

a pair of second wall panels connected to said first wall panels and adapted to form a container interior, said first wall panels in opposed relationship and said second wall panels in opposed relationship when said container interior is formed;

a first bottom flap connected to each first wall panel and adapted to extend therefrom under said container interior;

a first divider panel connected to each first bottom flap and adapted to extend into said container interior, said first divider panels each having an aperture formed therein and an elongated slit communicating with said aperture and extending from said aperture;

a second bottom flap connected to each second wall panel and adapted to extend therefrom under said container interior; and a second divider panel connected to each second bottom flap and adapted to extend into said container interior, said second divider panels having formed at edges thereof and bearing surfaces at the location of said notches, said second divider panels adapted to be positioned in said first divider panel apertures and said slits with said second divider panels abutting and in at least partial registry, said hand hold flaps being in registry with said notches when said second divider panels are positioned in said first divider panel apertures and slits, and said hand hold flaps positionable within said notches to bear against said second divider panel bearing surfaces, thereby facilitating lifting and carrying of said containers and providing at least partial support for the contents of said container.

11. The blank of claim 10 wherein each said first bottom flap defines an aperture therein in communication with the aperture formed in the first divider panel connected thereto, said second divider panels being positionable in the first bottom flap apertures.

12. The blank of claim 10 wherein said elongated slits each communicate at one end thereof with a first divider panel aperture and at the other end thereof with a hole formed in the first divider panel.

13. The blank of claim 12 wherein each first divider panel aperture is tapered over a substantial portion of the length thereof and narrows in the direction of the slit with which the aperture communicates, said first divider panel aperture having a curved end at the location of communication between said aperture and said slit.

14. The blank of claim 10 wherein the combined thickness of said second divider panels when abutting is greater than that of said slit when said slit is unstressed, whereby the first divider panels are adapted to be distorted at the slit locations and bear against the second divider panels to impede movement thereof and lock said first and second divider panels in position within said container interior.

15. The blank of claim 12 wherein the hole formed in each first divider panel is spaced from said first divider panel aperture, is circular in configuration, and is positioned along a line extending through a longitudinal axis of said first divider panel aperture and said slit.

16. The blank of claim 10 wherein each said second divider panel includes at least two adjacent sub-panels foldable relative to one another along a fold line.

17. The blank of claim 10 wherein each said second divider panel has indentations formed therein for receiving said first divider panels therein when said second divider panels are positioned in said first divider panel apertures and slits.

18. The blank of claim 17 wherein said indentations are partially defined by curved surfaces formed on said second divider panels.

* * * * *